United States Patent [19]

Byers

[11] Patent Number: 4,867,340

[45] Date of Patent: Sep. 19, 1989

[54] TRASH CAN LINER RETAINER

[76] Inventor: Thomas L. Byers, P.O. Box 26624, Oklahoma City, Okla. 73126

[21] Appl. No.: 194,062

[22] Filed: May 12, 1988

[51] Int. Cl.[4] ..... B65D 25/16

[52] U.S. Cl. ..... 220/404; 220/1 T; 206/813

[58] Field of Search ..... 220/1 T, 404; 206/813

[56] References Cited

U.S. PATENT DOCUMENTS

| | | | |
|---|---|---|---|
| 3,148,799 | 9/1964 | Meroney | 220/404 |
| 3,443,971 | 4/1967 | Wood | 220/440 |
| 3,817,444 | 6/1974 | Yoch | 220/404 |
| 4,589,570 | 5/1986 | Auten . | |
| 4,747,701 | 5/1988 | Perkins | 383/33 |

*Primary Examiner*—Stephen Marcus
*Assistant Examiner*—Gilbert W. Reece
*Attorney, Agent, or Firm*—Robert K. Rhea

[57] ABSTRACT

An upwardly open trash container having an outstanding horizontal rim terminating in a depending flange defines, with the container wall, downwardly facing bight surfaces. A layer of resilient adhesive material is bonded to the depending surfaces of the rim and flange for temporarily adhering to the top edge portion of a flexible trash can liner bag when manually placed in contact therewith.

1 Claim, 1 Drawing Sheet

TRASH CAN LINER RETAINER

BACKGROUND OF THE INVENTION

1. Field of the invention

This invention relates to containers and more particularly to a rubbish or trash container having means adjacent its upwardly open end for retaining the upwardly open end portion of a contained flexible bag.

It is common practice to place a flexible bag liner within a rubbish container which when filled, or nearly filled is closed by tying the top open end portion of the flexible bag as by a twist tie or the like. One of the problems associated with such an arrangement is that when placing trash in the container the open end portion of the flexible bag is frequently pulled inwardly within the confines of the trash container, rendering it difficult to maintain the rubbish within the bag and resulting in soiling the interior of the trash container when garbage or other refuse placed in container becomes interposed between the container and the outer wall surface of the flexible bag. This invention solves this undesirable condition by providing means for maintaining the top edge portion of the flexible bag in an outward overlapping relation with respect to the top end limit of the container wall.

2. Description of the Prior Art

Prior patents generally disclose flexible bag liner holding or locking apparatus such as an annular rim formed in a rolled configuration on the top outer periphery for receiving the flexible bag marginal open end portion while other patents disclose frame like devices supporting a non-selfsupporting bag in an upwardly open refuse receiving position.

The most pertinent prior patent is believed to be U.S. Pat. No. 4,589,570 which discloses an upwardly open container having a peripheral rim terminating in a downturned flange. The depending edge of the flange is provided with a circumferentially spaced apart series of triangular shaped projections which penetrate, in a piercing action, the open end portion of a flexible bag wall when engaged therewith. While this device holds the flexible bag it may have the disadvantage of the projections ripping or tearing the bag when objects of considerable mass are placed therein and the bag has not been fully inserted into its surrounding container. Further these pierced openings in the flexible bag may result in a non-airtight closure and the bag open end portion further is easily torn at the pierced positions.

SUMMARY OF THE INVENTION

A substantially conventional upwardly open rubbish or trash container having its top marginal side wall provided with a laterally outward and downward projecting flange forming a downward facing bight surface having a transverse dimension sufficient to receive the fingertips of a user's hand is provided with a layer of adhesive material bonded to the bight surface. The purpose of the adhesive material is to releasably hold the top marginal edge portion of a flexible refuse container bag formed from polyethylene material or the like.

The principal object of this invention is to provide an adhesive ring like layer secured to the downward facing surface of a trash can top wall marginal edge outstanding flange for adhering to the open end portion of a container flexible liner bag when placed therein.

DESCRIPTION OF THE PREFERRED EMBODIMENT

Figure 1:
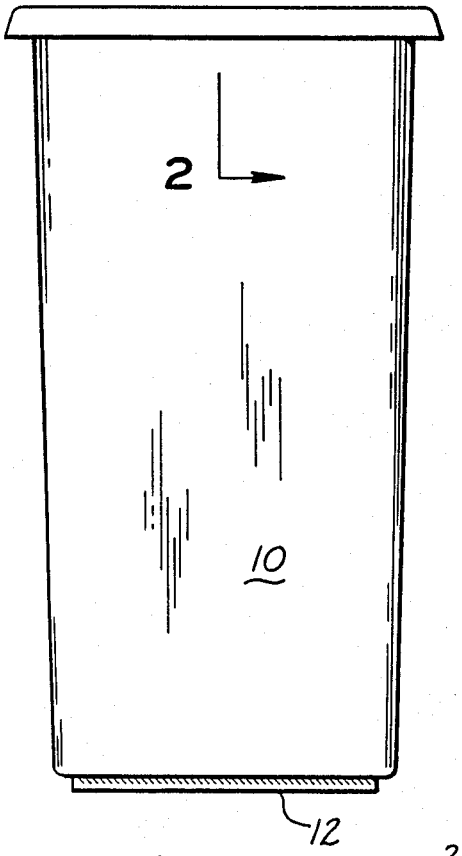
FIG. 1 is the side elevational view of a conventional refuse container.
Figure 2:
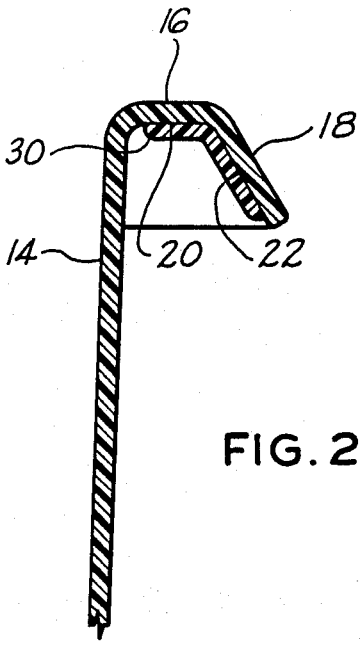
FIG. 2 is a fragmentary vertical cross sectional view, to a larger scale, taken substantially along the line 2—2 of FIG. 1; and, FIG. 3 is a view similar to FIG. 2 illustrating a fragment of a supported flexible container bag.

Like characters of reference designate like parts in those figures of the drawings in which they occur.

In the drawings:

Reference numeral 10 indicates a conventional upwardly open rubbish or trash container having a horizontal base or bottom 12 integrally connected with sidewall 14. The sidewall 14 terminates in an outstanding horizontal rim 16 and a downward and outwardly inclined flange 18. The rim portion 16 and flange 18 thus define a downwardly facing bight surface defined by a horizontal surface 20 and an adjacent downward and outwardly inclined inner surface 22 opposite the outer periphery of the container wall.

In use the container 10 is usually lined by a cooperating size flexible material bag 24 usually formed from polyethylene material. The height or vertical length of the bag 24 is usually substantially greater than the vertical height of the container wall 14 which permits the top edge portion 26 of the flexible bag to be manually extended outward and downwardly beyond the depending limit of the flange 18.

The above description is substantially conventional with most rubbish containers and contained trash can liner bags, and it is with such a combination that the present invention improves the performance of the components.

In carrying out the invention a relatively thick layer of adhesive material 30 is bonded to the rim and flange depending surfaces 20 and 22. The adhesive material is preferably of the type having an affinity for polyethylene material and at least temporarily adhering thereto. The adhesive is preferably resilient to finger pressure so that the top edge portion 26 of the polyethylene bag may be manually forced into contiguous contact with surface of the adhesive layer by manually gripping the rim and flange with the overlying bag end portion 26 and the user's fingertips, not shown, entering the bight for forcing the bag against the surface thereof. Prior to use of the containers and while in storage the adhesive is preferably covered with a protective layer or dust cover, not shown, as is conventional with peel-off article wall-mounting adhesives.

OPERATION

Figure 3:
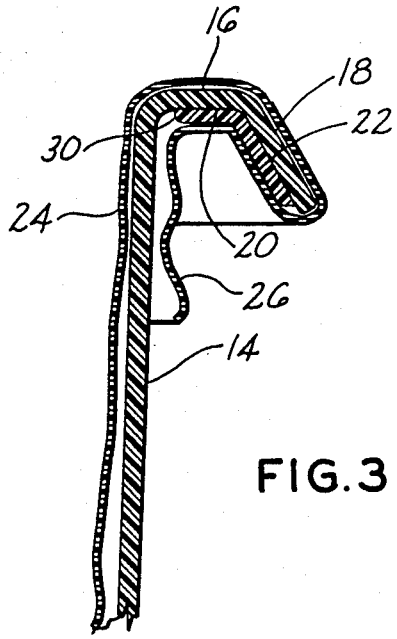

The flexible bag 24 is placed within the container 10 and its top edge wall portion 26 placed in contact with the adhesive 30. The adhesive normally maintains the perimeter of the bag in the position shown by FIG. 3 until it is desired to remove the bag from the container. This is accomplished by manually grasping the depending edge portion of the bag top wall perimeter 26 and manually moving it downward and outwardly relative to the adhesive 30 in a peeling away separating action of the bag from the adhesive. The bag top wall portion 26 is then centrally positioned relative to container 10 and secured in a bag closing action as by twist tie,(not shown). The adhesive 30 remains under the rim and flange for receiving another bag in a like manner.

Obviously the invention is susceptible to changes or alterations without defeating its practicability. Therefore, I do not wish to be confined to the preferred embodiment shown in the drawings and described herein.

I claim:

1. In a flexible bag liner receiving upwardly open refuse container having a horizontal outstanding rim at the upper limit of its peripheral wall terminating an annular downward and outwardly directed flange an defining an unobstructed finger receiving space between the annular flange and the adjacent perimeter of the container wall the improvement comprising:

adhesive means consisting of a resilient layer of adhesive material yielding under manually applied finger pressure bonded to the depending surface of the flange and rim; and a peel-away protective layer overlying the adhesive, said adhesive normally adhering to the surface of a refuse container bag liner when the bag is placed in contact therewith by impinging the open end perimeter portion of a doubled back upon itself position of the bag between the palm and fingers of a user when gripping the outer surface of the annular flange and the surface of the adhesive underlying the annular flange, whereby then doubled back upon itself position of the bag open end perimeter substantially increases the coefficient of sliding friction between the bag, the container rim and annular flange.

* * * * *